US005414868A

United States Patent [19]

Crawford

[11] Patent Number: 5,414,868

[45] Date of Patent: May 16, 1995

[54] GOLF GLOVE WITH GRIP-MAINTAINING STRAPS

[76] Inventor: Jerry G. Crawford, 4301-G Central Ave., Charlotte, N.C. 28205

[21] Appl. No.: 81,602

[22] Filed: Jun. 23, 1993

[51] Int. Cl.[6] ..... A41D 19/00

[52] U.S. Cl. ..... 2/160; 2/161.2; 2/917

[58] Field of Search ..... 2/159, 161.1, 161.2, 2/907, 910, 917, 160, 161.3, 161.4, 161.6

[56] References Cited

U.S. PATENT DOCUMENTS

| | | | |
|---|---|---|---|
| D. 328,379 | 7/1992 | Jones . | |
| 2,083,604 | 6/1937 | Hay | 2/161.2 |
| 2,852,779 | 9/1958 | Roessler | 2/161.2 |
| 3,105,972 | 10/1963 | Christopher | 2/161.2 |
| 3,348,238 | 10/1967 | Hydock | 2/161.2 |
| 3,559,212 | 2/1971 | Skovron | 2/161.2 |
| 3,918,097 | 11/1975 | Mlodoch | 2/161.1 |
| 4,796,306 | 1/1989 | Mitchell | 2/160 |
| 4,882,787 | 11/1989 | Hull et al. . | |
| 4,962,547 | 10/1990 | Minnick . | |
| 5,022,094 | 6/1991 | Hames et al. | 2/161.1 |
| 5,033,120 | 7/1991 | Myers . | |
| 5,170,508 | 12/1992 | Kawada . | |

*Primary Examiner*—Clifford D. Crowder
*Assistant Examiner*—Michael A. Neas
*Attorney, Agent, or Firm*—Shefte, Pinckney & Sawyer

[57] ABSTRACT

An improved golf glove for assisting a golfer having a muscular impairment in maintaining the golfer's hand in proper gripping position about a golf club handle includes a pair of elongate straps fixed to the glove body at opposite sides of the thumb extension, each strap having a fastener portion along its outwardly extending length, and a mating fastener arrangement at the backhand side of the glove body, including selected locations on the finger and thumb extensions, for securement of the straps when the golfer grips the club handle, thereby to retain the golfer's thumb and fingers in proper gripping disposition during swinging of the club.

15 Claims, 4 Drawing Sheets

GOLF GLOVE WITH GRIP-MAINTAINING STRAPS

BACKGROUND OF THE INVENTION

The present invention relates generally to golf gloves worn on a golfer's hand to improve the golfer's gripping of a golf club handle during swinging movements and, more particularly, to a novel golf glove having a strap arrangement to assist the golfer in maintaining the golfer's hand in a gripping position about a golf club handle.

In playing the game of golf, the conventional wisdom is that a golfer should grip the handle of a golf club with both hands adjacent one another, a right-handed golfer having his left hand gripping the uppermost end of the club handle with his right hand immediately therebelow and a left-handed golfer the opposite, with the club handle cradled essentially by the fingers of both hands and, during swinging movements, the uppermost hand should provide the firmest gripping force. The proper gripping disposition of the golfer's hands and the desired degree of gripping force to be exerted by each hand requires a delicate balance between the positioning of the fingers of each hand and the gripping force exerted by the fingers. The correct gripping technique can be relatively difficult to train and learn. However, for a golfer experiencing arthritis, nerve damage, or other loss of muscular strength and control in the hands, correct gripping of a golf club can be nearly impossible.

SUMMARY OF THE INVENTION

It is accordingly an object of the present invention to provide an improved golf glove which can be worn by golfers experiencing a debilitating condition affecting the hand muscles and which will enable the golfer to secure and maintain the affected hand or hands in a proper club-gripping disposition about a golf club handle during swinging thereof.

Briefly summarized, the golf glove of the present invention basically includes a glove body having a palm portion and backhand portion which together define therebetween a hand pocket, a thumb opening, and plurality of finger openings. A pair of elongate straps are affixed to the backhand portion of the glove body, one strap being fixed at one end thereof on one side of the thumb opening and the other strap being affixed at one end thereof on the opposite side of the thumb opening. Each strap has a free unsecured length extending from its fixed end and at least one fastener portion on the free end thereof. A fastener arrangement matable with the respective fasteners of the straps is fixed to the backhand portion of the glove body to enable selective attachment and detachment of the strap fasteners to and from the fastener arrangement for selectively closing the glove body in gripping disposition about a golf club handle.

Preferably, each of the backhand and palm portions of the glove body include thumb and finger extensions defining thumb and finger pockets. The fastener arrangement is fixed to the backhand portion of the glove body at a plurality of predetermined spaced locations, including fastener portions fixed to the thumb and finger extensions, for respective mated attachment to the fastener portions of the straps.

For example, the fastener arrangement may include a finger fastener portion fixed to one of the finger extensions of the backhand portion of the glove body, a thumb fastener portion fixed to the thumb extension of the backhand portion of the glove body, and a backhand fastener portion fixed to the backhand portion of the glove body at a location adjacent the finger extensions. One strap is fixed to the backhand portion of the glove body to the side of the thumb extension opposite the finger extensions in order to extend across the palm portion into mated attachment to the finger fastener portion and the other strap is fixed to the backhand portion of the glove body adjacent the finger extensions for extension across the thumb extension into mated attachment to the thumb fastener portion and to the backhand fastener portion.

It is contemplated that golf gloves in accordance with the present invention may be fabricated to be worn on either or both of a golfer's hands, depending upon a golfer's need for assistance in maintaining a proper grip about a golf club. Of course, the invention is adaptable to the needs of either a left-handed or right-handed golfer.

In one contemplated embodiment, a golf glove adapted to the worn on the uppermost club-gripping hand of a golfer's pair of hands has the aforementioned one strap fixed to the backhand portion of the glove body to the side of the thumb extension opposite the finger extensions and the other strap affixed to the backhand portion of the glove body adjacent the opening to the ring finger pocket. The fastener arrangement includes first and second fastener portions fixed respectively to the ring finger and little finger extensions of the backhand portion of the glove body for successive mated attachment to the fastener portion of the one strap and third, fourth, fifth, and sixth fastener portions fixed respectively to the middle finger, forefinger, and thumb extensions and to the thumb crotch region of the backhand portion of the glove body for successive mated attachment to the fastener portion of the other strap.

A golf glove adapted to be worn on the lowermost club-gripping hand of the golfer's pair of hands has the aforementioned one strap fixed to the backhand portion of the glove body to the side of the thumb extension opposite the finger extensions and the other strap fixed to the backhand portion of the glove body adjacent the opening to the forefinger pocket. The fastener arrangement includes first and second fastener portions fixed respectively to the thumb and middle finger extensions of the backhand portion of the glove body for successive mated attachment to the fastener portion of the one strap and third, fourth, and fifth fastener portions fixed respectively to the thumb and forefinger extensions of the backhand portion of the glove body and to the backhand portion of the glove body adjacent the ring finger extension for successive mated attachment to the fastener portion of the other strap.

Of course, it is contemplated that the various fastener portions of the fastener arrangement may be provided by a fastener member which is affixed to the backhand portion of the glove body to occupy a predominant continuous area thereof. Preferably, the respective fastener portions of the straps and the fastener arrangement are matable hook-and-loop fastener components.

DESCRIPTION OF THE PREFERRED EMBODIMENT

Figure 1:
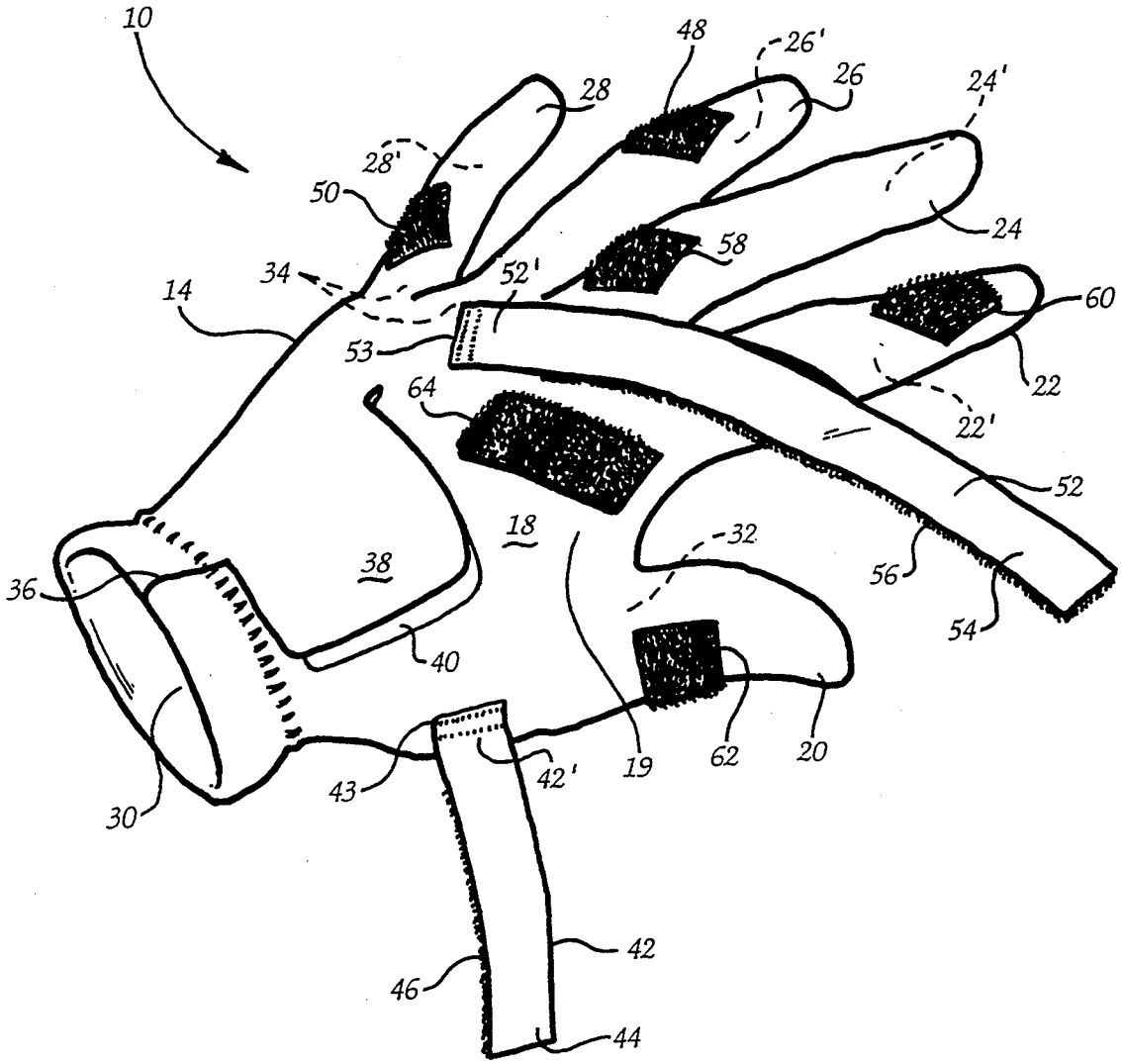
FIG. 1 is a perspective view of a golf glove in accordance with a preferred embodiment of the present invention adapted to be worn on the left, i.e., uppermost, club-gripping hand of a right-handed golfer, the glove being illustrated in an unworn disposition with the securing straps unattached to the mating fastener arrangement on the backhand portion of the glove body.
Figure 2:
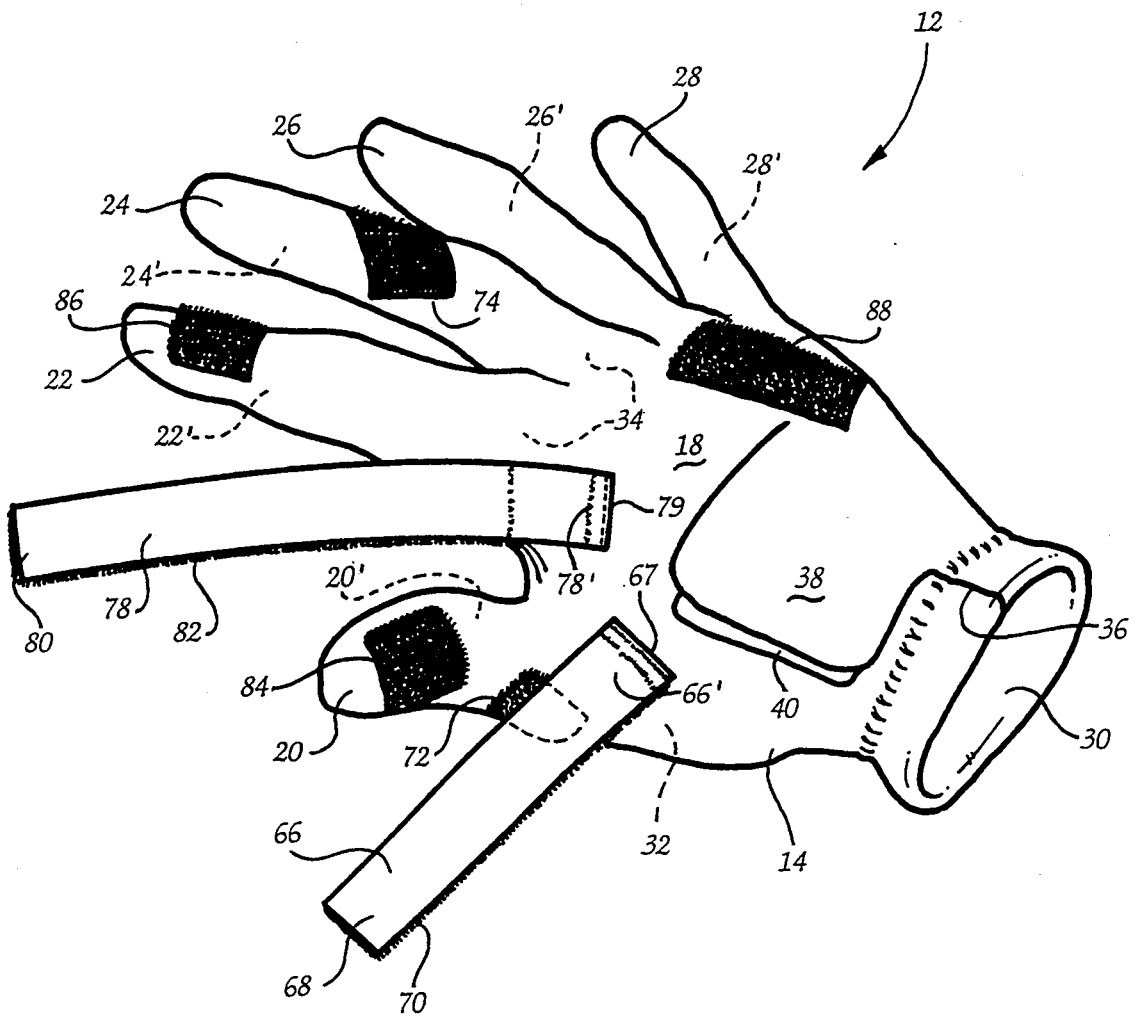
FIG. 2 is a similar perspective view of a golf glove in accordance with a preferred embodiment of the present invention adapted to be worn on the right, i.e., lowermost, club-gripping hand of a right-handed golfer, the glove being illustrated in an unworn disposition with the securing straps unattached to the mating fastener arrangement on the backhand portion of the glove body.

Referring now to the accompanying drawings and initially to FIGS. 1 and 2, a pair of golf gloves adapted to be worn on the left (uppermost) and right (lowermost) hands of a physically impaired right-handed golfer for the aforementioned purposes of club-gripping assistance are shown at 10 and 12, respectively. As will of course be understood by those persons skilled in the art, the invention is equally adaptable to golf gloves to be worn by left-handed golfers, the gloves in such case being the mirror images of the respective gloves 10,12.

As will be recognized, the main body 14 of each golf glove 10,12 is of a substantially conventional construction, fabricated from leather or a suitable synthetic leather or other substitute material to basically provide the glove body 14 with a palm portion 16 (see FIGS. 4 and 6) and a backhand portion 18, each having thumb, forefinger, middle finger, ring finger, and little finger extensions 20,22,24,26,28, respectively, and sewn or otherwise secured together to provide an interior hand pocket 30 with individual thumb and finger openings 32,34 into respective thumb and finger pockets 20',22',24',26',28'. A lengthwise extending slit 36 is formed centrally in the backhand portion 18 of the glove body 14 at the entrance to the hand pocket 30, with mating closures 38,40, typically hook-and-loop fastener components such as Velcro closure components, to selectively enlarge and close the entrance opening to the hand pocket 30 for the wearer's ease in inserting and removing the hand into and from the hand pocket 30 and to enable the glove to be firmly secured on the hand during wearing.

In accordance with the present invention, each glove 10,12 is provided with a pair of elongate straps, each fixed at one end to the backhand portion of the glove body in a disposition to be able to extend about the glove body when formed in a club-gripping orientation during wearing and each strap having at least one fastener portion along its outwardly extending length, and a mating fastener arrangement is affixed to the backhand portion of the glove body at selected locations for securement of the extending lengths of the respective straps.

Figure 3:
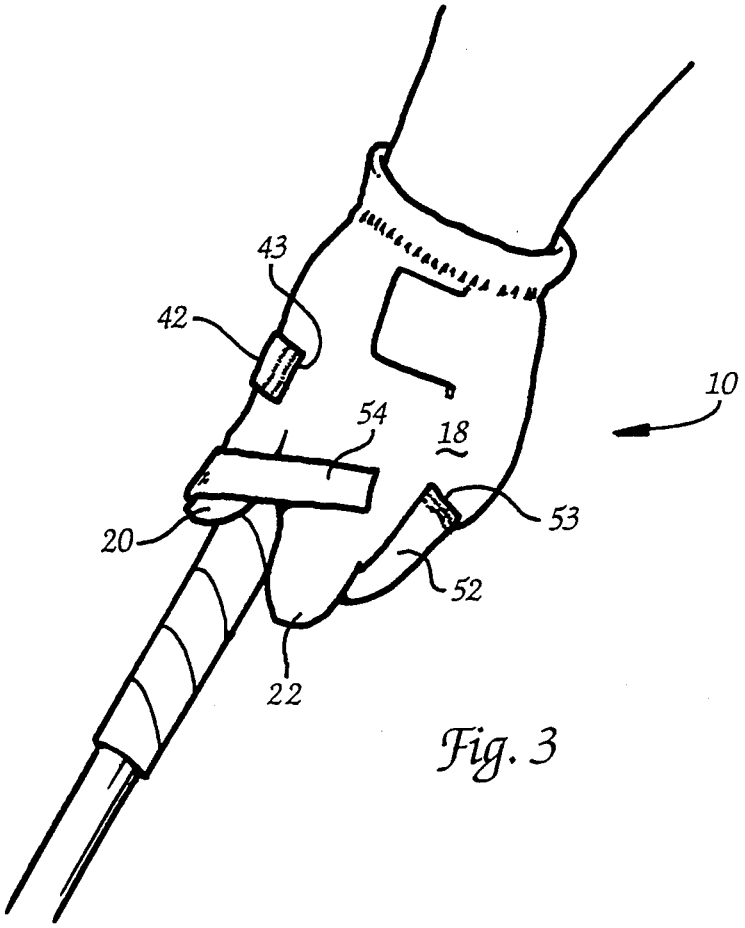
FIG. 3 is a perspective view of the left-hand golf glove of FIG. 1 as worn and used in gripping the handle of a golf club with the straps secured in mating relation to the fastener arrangement on the backhand portion of the glove body.
Figure 4:
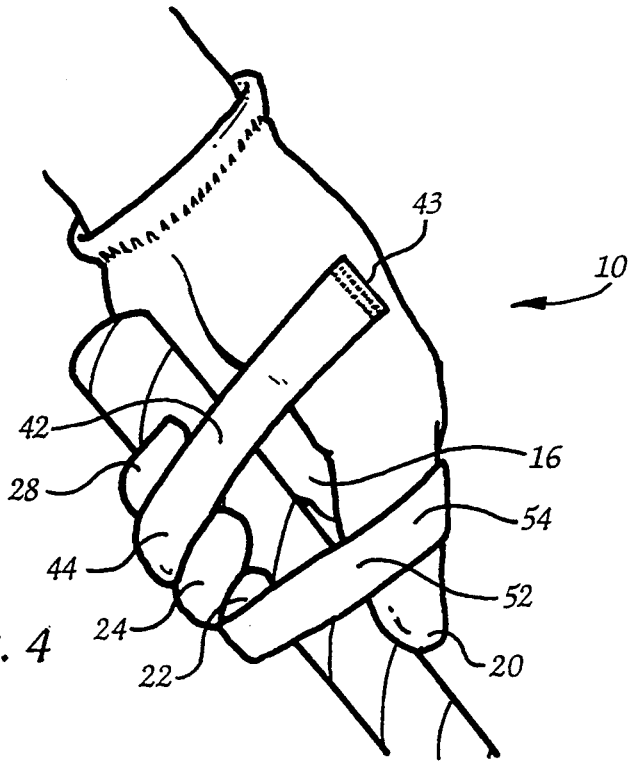
FIG. 4 is another perspective of the golf glove of FIG. 3, taken from the opposite side of the wearer's hand.

More particularly, with specific reference to the left glove 10 of FIG. 1, a first strap 42 is affixed at one end 42' to the backhand portion 18 of the glove body 14 at 43 immediately adjacent the thumb extension 20 at the side thereof opposite the finger extensions 22,24,26,28 and has a free unsecured length 44 extending outwardly from the backhand portion 18 away from the thumb and finger extensions 20,22,24,26,28 at approximately a right angle to the lengthwise extent of the thumb extension 20. The strap 42 has a sufficient length, preferably approximately 4 inches, to extend across the palm portion 16 and across the ring and little finger extensions 26,28 of the backhand portion 18 when the glove 10 is held during wearing with the finger extensions curled in a conventional club-gripping disposition, as shown in FIGS. 3 and 4 and as will be more fully described hereinafter. The predominant extent of the free length 44 of the strap 42 carries an integral fastener portion 46, preferably one component of a hook-and-loop fastener assembly, at the side of the strap 42 which faces the palm portion 16 and finger extensions 22,24,26,28 in such club-gripping disposition. A pair of fastener portions 48,50 matable with the strap's fastener portion 46, e.g, the other component of a hook-and-loop fastener assembly, are affixed to the ring and little finger extensions 26,28 of the backhand portion 18 of the glove body 14 for securement of the fastener portion 46 on the strap 42 in the club-gripping disposition of the glove 10 shown in FIGS. 3 and 4. In accordance with conventional teachings regarding proper golf club gripping technique, the fastener portion 48 is located on the ring finger extension 26 to be generally adjacent the wearer's outermost finger joint, while the fastener portion 50 is located on the little finger extension 28 to be generally adjacent the wearer's innermost finger joint (see FIG. 1) whereby the fastener portions 48,50 align with each other and with the linear extent of the free length 44 of the strap 42 for securement of the strap 42 when a golf club handle is properly gripped while wearing the glove 10 (see FIG. 4).

Another strap 52 is affixed at one end 52' to the backhand portion 18 of the glove body 14 at 53 adjacent the opening 34 into the ring finger pocket 26, with a free lengthwise extent 54 of the strap 52 extending therefrom angularly outwardly across the middle finger extension 24 and the forefinger extension 22, the strap 52 being of a sufficient length, preferably approximately 9 inches, to extend across such finger extensions, and then back around the thumb extension 20 to the thumb crotch region 19 of the backhand portion 18 when the glove 10 is held during wearing in the club-gripping disposition of FIGS. 3 and 4. As with the strap 42, the predominant lengthwise extent 54 of the strap 52 carries an integral fastener portion 56, again preferably a hook-and-loop fastener component. The backhand portion 18 of the glove body 14 is further provided with four additional fastener portions 58,60,62,64 affixed respectively to the middle finger extension 24, the forefinger extension 22, the thumb extension 20, and the thumb crotch region 19 for mated securement with the fastener portion 56 of the strap 52. To comport with conventional club-gripping technique, the fastener portion 58 is located on the middle finger extension 24 to be generally between the wearer's knuckle and innermost finger joint, the fastener portion 60 is located on the forefinger extension 22 to be generally adjacent the wearer's outermost finger joint, the fastener portion 62 is located on the thumb extension 20 to be generally adjacent the wearer's thumb joint, and the fastener portion 64 is located at the side of the thumb crotch region 19 adjacent the forefinger extension 22 (see FIG. 1) whereby the fastener portions 58,60,62,64 are aligned along the backhand curvature of the glove substantially in line with the extending free length of the strap 52 when a golf club handle is properly gripped while wearing the glove to enable the strap 52 to be secured to the fastener portions 58,60,62,64 (see FIGS. 3 and 4).

As will thus be understood, the glove 10 enables a right-handed golfer having any muscular impairment of the left (uppermost) hand which inhibits the golfer's ability to maintain a secure grip on a golf club during swinging to secure the hand in proper club-gripping disposition on the handle of a golf club using the mating fastener portions on the straps 42,52 and the glove body 14, as aforedescribed. More specifically, a golfer wearing the glove 10 would initially place the left hand in proper position on the upper end of the golf club handle with the thumb placed thereon and the fingers curled thereabout according to conventional club-gripping technique and would then secure the strap 42 successively to the fastener portions 48,50, and the strap 52 successively to the fastener portions 58,60, and then around the club handle to the fastener portions 62,64, all as depicted in FIGS. 3 and 4. With the straps 42,52 thusly secured, each finger of the golfer's left hand is constrained to remain in club-gripping disposition on the club handle throughout any ensuing swinging movements of the club despite the muscular impairment suffered by the golfer.

As of course will be understood, a golfer may alternatively suffer a similar impairment of the lowermost hand which could similarly affect the golfer's ability to properly maintain a secure grip on a golf club handle during swinging and, accordingly, the present invention additionally contemplates the possibility of providing a golf glove adapted to be worn on the golfer's lowermost hand for the same purpose of securing the hand in club-gripping disposition. The glove 12 shown in FIGS. 2, 5, and 6 is specifically adapted for this purpose to be worn on the right hand of a right-handed golfer.

Figure 5:
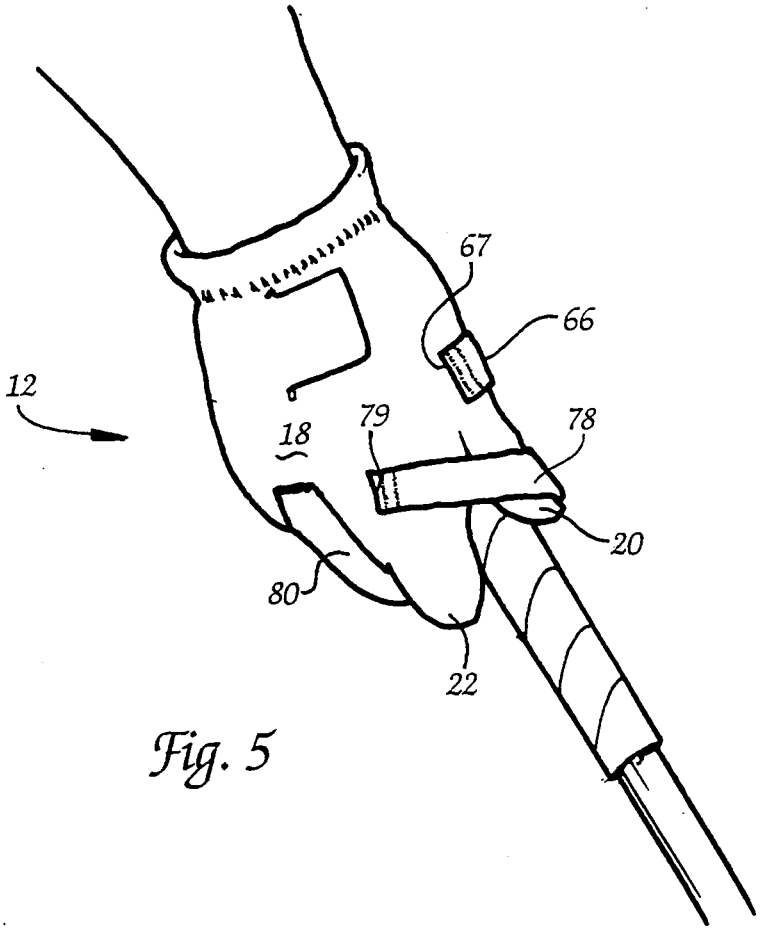
FIG. 5 is a perspective view similar to FIG. 3 of the right-hand golf glove of FIG. 2 as worn and used in gripping the handle of a golf club with the straps secured in mating relation to the fastener arrangement on the backhand portion of the glove body.
Figure 6:
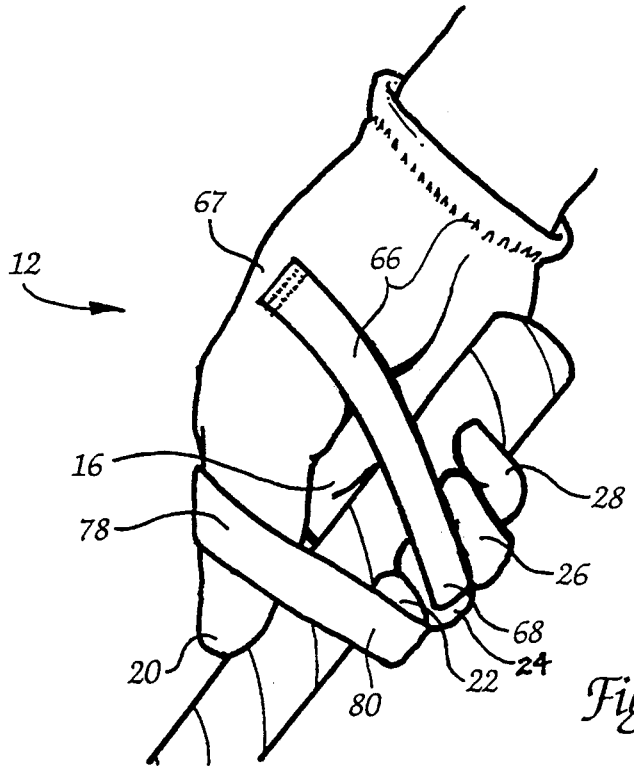
FIG. 6 is another perspective of the golf glove of FIG. 5, taken from the opposite side of the wearer's hand.

More particularly, with initial reference to FIG. 2, the glove 12 has a first strap 66 affixed at one end 66' to the backhand portion 18 of the glove body 14 at 67 adjacent the thumb extension 20 at the side thereof opposite the finger extensions 22,24,26,28, with a free lengthwise extent 68 of the strap 66 extending outwardly from the glove body away from the finger extensions at an acute angle with respect to the thumb extension 20, the length of the free extent 68 of the strap 66 being sufficient to extend in succession over the thumb and middle finger extensions 20,24, in the normal club-gripping disposition of the lower (right) hand by a right-handed golfer in accordance with conventional technique, as shown in FIGS. 5 and 6. For this purpose, the strap 66 preferably has a length of approximately 4 inches. The predominant lengthwise dimension of the free extent 68 of the strap 66 carries an integral hook-and-loop fastener component or other fastener portion 70 at the side of the strap 66 which faces the thumb and finger extensions 20,22,24 in such disposition. Mating hook-and-loop fastener portions or other appropriate fastener components 72,74 are respectively fixed on the thumb extension 20 and the middle finger extension 24 to mate with the fastener portion 70 of the strap 66 in such club-gripping disposition. Specifically, in accordance with conventional gripping technique, the fastener portion 72 is located on the base of the thumb extension 20 adjacent the thumb knuckle and the fastener portion 74 is located on the middle finger extension 24 to be generally between the wearer's innermost and outermost finger joints, thereby to align with one another and with the strap 66 when the glove 12 is worn while properly gripping a golf club handle to enable the fastener portion 70 of the strap 66 to be secured to the fastener portions 72,74.

A second strap 78 is affixed at one end 78' to the backhand portion 18 of the glove body 14 at 79 adjacent the forefinger extension 22, with a free lengthwise extent 80 projecting outwardly therefrom away from the finger extensions at an acute angle with respect to the forefinger extension 22. The lengthwise extent 80 of the strap 78 is of a sufficient dimension, preferably approximately 7 to 8 inches, to enable the strap to extend across the thumb extension 20 and the finger extensions to the central region of the backhand portion 18 when the glove 12 is worn in the conventional club-gripping disposition of FIGS. 5 and 6. Hereagain, the predominant length of the free extent 80 of the strap 78 carries an integral hook-and-loop fastener component or other fastener portion 82 at the side thereof which faces the thumb and finger extensions and the backhand portion of the glove body in such gripping disposition. In conformity to the normal club-gripping disposition of a right-handed golfer's right hand under conventional technique, mating hook-and-loop fastener portions 84,86,88 are affixed respectively to the outermost end of the thumb extension 20 to be adjacent the wearer's thumb joint, to the outermost end of the forefinger extension 22 to be adjacent the wearer's outermost finger joint, and to the backhand portion 18 of the glove body 14 adjacent the ring finger extension 26 for successive mated engagement with the fastener portion 82 of the strap 78 when a golf club handle is properly gripped while wearing the glove 12.

Thus, as will be understood from FIGS. 5 and 6, an impaired right-handed golfer wearing the glove 12 on his right hand is enabled to securely strap his hand in place in proper gripping disposition about the handle of a golf club by initially placing his right hand with the fingers and thumb curled about the club handle in accordance with normal gripping technique and then securing the fastener portion 70 of the first strap 66 successively to the fastener portion 72 at the base of the thumb extension 20 and then to the fastener portion 74 on the middle finger extension 24, followed by securement of the fastener portion 82 of the second strap 78 successively to the fastener portion 84 at the end of the thumb extension 20, then to the fastener portion 86 of the forefinger extension 22, and then across the middle and ring finger extensions into engagement with the fastener portion 88 on the backhand portion 18 of the glove body 14. With the straps 66,78 thusly secured in place, the golfer's thumb and fingers are securely held in proper club-gripping disposition throughout any ensuing swinging movement of the golf club.

Of course, as those persons skilled in the art will readily recognize and understand, the present invention is not limited to the particular arrangement of straps and fastener portions as above described. Rather, it is specifically contemplated that other alternative arrangements may be equally serviceable and provide equally suitable results within the concept of the present invention. For example, it is contemplated that a predominant area of the backhand portion 18 of the glove body 14 may carry a single continuous fastener member, e.g., occupying substantially the entire length of each of the thumb and finger extensions and a substantial part of the remainder of the backhand portion 18, which will enable the securement of the straps of either the glove 10 or the glove 12 to be varied as necessary to accommodate any individual golfer's particular club-gripping technique, even if the golfer's technique deviates from the normal disposition of the thumb and fingers under conventionally taught club-gripping technique. In addition, it is contemplated that other forms of fastening devices than mating hook-and-loop fastener components may be utilized. Also, if desired, the strap and fastener arrangements of the present invention could be adapted to fingerless gloves which may be preferred by some golfers.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A golf glove to be worn on a hand of a golfer to assist in maintaining the golfer's hand in a gripping position about a golf club handle during swinging movements thereof, the golf glove comprising:

(a) a glove body having a palm portion and a backhand portion, the palm and backhand portions defining therebetween a hand pocket, a thumb opening, and a plurality of finger openings; and (b) means for securing the glove body in a club-gripping disposition, the securing means comprising:

(i) a pair of elongate straps, one strap being fixed at one end thereof to the backhand portion generally adjacent one side of the thumb opening and the other strap being fixed at one end thereof to the backhand portion generally adjacent the opposite side of the thumb opening, each strap having a free unsecured length extending from its fixed end and at least one fastener portion on the free length thereof; and (ii) fastener means fixed to the backhand portion and matable with the respective fasteners of the straps for selective attachment thereto and detachment therefrom for selectively closing the glove body in gripping disposition about a golf club handle.

2. A golf glove according to claim 1 wherein the fastener means is fixed to the backhand portion at a plurality of predetermined spaced locations for respective mating securement with the fastener portions of the straps.

3. A golf glove according to claim 2 wherein each of the backhand and palm portions of the glove body include thumb and finger extensions defining thumb and finger pockets, and the fastener means includes fastener portions fixed to the thumb and finger extensions of the backhand portion of the glove body for mated attachment to the at least one fastener portions of the straps.

4. A golf glove according to claim 3 wherein the fastener means includes a finger fastener portion fixed to one of the finger extensions of the backhand portion of the glove body, a thumb fastener portion fixed to the thumb extension of the backhand portion of the glove body, and a backhand fastener portion fixed to the backhand portion of the glove body adjacent the finger extensions, and the one strap is fixed to the backhand portion of the glove body to the side of the thumb extension opposite the finger extensions for extension across the palm portion into mated attachment to the finger fastener portion and the other strap is fixed to the backhand portion of the glove body adjacent the finger extensions for extension across the thumb extension into mated attachment to the thumb fastener portion and the backhand fastener portion.

5. A golf glove according to claim 4 wherein the golf glove is adapted to be worn on the uppermost club-gripping hand of a golfer's pair of hands, the backhand portion of the glove body includes a thumb crotch region, the finger extensions of the backhand and palm portions of the glove body include forefinger, middle finger, ring finger, and little finger extensions defining therebetween individual forefinger, middle finger, ring finger, and little finger pockets, the other strap is fixed to the backhand portion of the glove body adjacent the ring finger opening, and the fastener means includes first and second fastener portions fixed respectively to the ring finger and little finger extensions of the backhand portion of the glove body for successive mated attachment to the at least one fastener portion of the one strap and third, fourth, fifth, and sixth fastener portions fixed respectively to the middle finger, forefinger, and thumb extensions and the thumb crotch region of the backhand portion of the glove body for successive mated attachment to the at least one fastener portion of the other strap.

6. A golf glove according to claim 4 wherein the golf glove is adapted to be worn on the lowermost club-gripping hand of a golfer's pair of hands, the finger extensions of the backhand and palm portions of the glove body include forefinger, middle finger, ring finger, and little finger extensions defining therebetween individual forefinger, middle finger, ring finger, and little finger pockets, the other strap is fixed to the backhand portion of the glove body adjacent the forefinger opening, the fastener means includes first and second fastener portions fixed respectively to the thumb and middle finger extensions of the backhand portion of the glove body for successive mated attachment to the at least one fastener portion of the one strap and third, fourth, and fifth fastener portions fixed respectively to the thumb and forefinger extensions of the backhand portion of the glove body and to the backhand portion of the glove body adjacent the ring finger extension for successive mated attachment to the at least one fastener portion of the other strap.

7. A golf glove according to claim 2 wherein the fastener means comprises a fastener member occupying a predominant continuous area of the backhand portion.

8. A golf glove according to claim 1 wherein the fastener portions of the straps and the fastener means comprise matable hook-and-loop fastener components.

9. A golf glove according to claim 1 wherein the free unsecured length of each strap extends from its fixed end generally outwardly away from the backhand portion.

10. A golf glove to be worn on a hand of a golfer to assist in maintaining the golfer's hand in a gripping position about a golf club handle during swinging movements thereof, the golf glove comprising:

(a) a glove body having a palm portion and a backhand portion, the palm and backhand portions defining therebetween a hand pocket, a thumb opening, and a plurality of finger openings, each of the backhand and palm portions of the glove body including thumb and finger extensions defining thumb and finger pockets; and (b) means for securing the glove body in a club-gripping disposition, the securing means comprising:

(i) a pair of elongate straps, one strap being fixed at one end thereof to the backhand portion on one side of the thumb opening and the other strap being fixed at one end thereof to the backhand portion on the opposite side of the thumb opening, each strap having a free unsecured length extending from its fixed end and at least one fastener portion on the free length thereof; and (ii) fastener means fixed to the backhand portion at a plurality of predetermined spaced locations to be respectively matable with the respective fasteners of the straps for selective attachment thereto and detachment therefrom for selectively closing the glove body in gripping disposition about a golf club handle, the fastener means including fastener portions fixed to the thumb and finger extensions of the backhand portion of the glove body for mated attachment to the at least one fastener portions of the straps.

11. A golf glove according to claim 10 wherein the fastener means includes a finger fastener portion fixed to one of the finger extensions of the backhand portion of the glove body, a thumb fastener portion fixed to the thumb extension of the backhand portion of the glove body, and a backhand fastener portion fixed to the backhand portion of the glove body adjacent the finger extensions, and the one strap is fixed to the backhand portion of the glove body to the side of the thumb extension opposite the finger extensions for extension across the palm portion into mated attachment to the finger fastener portion and the other strap is fixed to the backhand portion of the glove body adjacent the finger extensions for extension across the thumb extension into mated attachment to the thumb fastener portion and the backhand fastener portion.

12. A golf glove according to claim 11 wherein the golf glove is adapted to be worn on the uppermost club-gripping hand of a golfer's pair of hands, the backhand portion of the glove body includes a thumb crotch region, the finger extensions of the backhand and palm portions of the glove body include forefinger, middle finger, ring finger, and little finger extensions defining therebetween individual forefinger, middle finger, ring finger, and little finger pockets, the other strap is fixed to the backhand portion of the glove body adjacent the ring finger opening, and the fastener means includes first and second fastener portions fixed respectively to the ring finger and little finger extensions of the backhand portion of the glove body for successive mated attachment to the at least one fastener portion of the one strap and third, fourth, fifth, and sixth fastener portions fixed respectively to the middle finger, forefinger, and thumb extensions and the thumb crotch region of the backhand portion of the glove body for successive mated attachment to the at least one fastener portion of the other strap.

13. A golf glove according to claim 11 wherein the golf glove is adapted to be worn on the lowermost club-gripping hand of a golfer's pair of hands, the finger extensions of the backhand and palm portions of the glove body include forefinger, middle finger, ring finger, and little finger extensions defining therebetween individual forefinger, middle finger, ring finger, and little finger pockets, the other strap is fixed to the backhand portion of the glove body adjacent the forefinger opening, the fastener means includes first and second fastener portions fixed respectively to the thumb and middle finger extensions of the backhand portion of the glove body for successive mated attachment to the at least one fastener portion of the one strap and third, fourth, and fifth fastener portions fixed respectively to the thumb and forefinger extensions of the backhand portion of the glove body and to the backhand portion of the glove body adjacent the ring finger extension for successive mated attachment to the at least one fastener portion of the other strap.

14. A golf glove according to claim 10 wherein the fastener means comprises a fastener member occupying a predominant continuous area of the backhand portion.

15. A golf glove according to claim 10 wherein the fastener portions of the straps and the fastener means comprise matable hook-and-loop fastener components.

* * * * *